US005540177A

United States Patent [19]

Masters

[11] Patent Number: 5,540,177

[45] Date of Patent: Jul. 30, 1996

[54] INFLATABLE BOAT BRA

[76] Inventor: Lance V. Masters, P.O. Box 60, Mason City, Iowa 50402-60

[21] Appl. No.: 493,693

[22] Filed: Jun. 22, 1995

[51] Int. Cl.[6] ..... B63B 17/00

[52] U.S. Cl. ..... 114/361; 441/40

[58] Field of Search ..... 114/343, 345, 114/347, 348, 361, 364; 441/35, 40, 41, 42, 44

[56] References Cited

U.S. PATENT DOCUMENTS 2,876,467 3/1959 Lund ..... 441/40
5,033,401 7/1991 Bartlett ..... 441/40

FOREIGN PATENT DOCUMENTS 1176537 10/1984 Canada ..... 114/361

*Primary Examiner*—Jesus D. Sotelo

[57] ABSTRACT

The Inflatable Boat Bra is a mechanism designed to protect inflatable objects from leakage caused by laceration and abrasion. The second purpose is to furnish a way to organize the equipment commonly used in inflatable boats. The Boat Bra is made of a fabric that is highly abrasion resistant to cover the air tubes of an inflatable boat. The fabric is fastened in position by the use of a plurality of grommets on the fabric and a plurality of D rings glued to the inflatable tube of the boat. These are fastened together by the use of shock cords. This method allows the Bra fabric to slide over the inflatable tube fabric without damage to either. On the inside of the boat mesh bags are fastened to the fabric in such a manner as to allow them to hang to the boat floor. This furnishes a method of organizing equipment in a way that it is still visible and accessible.

1 Claim, 4 Drawing Sheets

BOAT PLAN

D RING

GROMMET

SHOCK CORD

Elastic rubber interior and material exterior.

MESH BAG OR POUCH

SECTION THRU BOAT TUBE

INFLATABLE BOAT BRA

BACKGROUND

1. Field of the Invention

This invention relates to an abrasion and laceration resistant covering (Bra) for inflatable objects.

2. Description of Prior Art

Before this date inflatable boats have created a great deal of owner frustration due to their easily lacerated fabric and then tending to deflate. Lacerations are produced by unavoidable contact with sharp objects. Barnacles, nails protruding from docks and sharp rocks are a few of the offenders. Laceration holes are a major factor in shortening the life of inflatable boats.

Boats of this type tend to be expensive. They range from $1400.00 to $2800.00 for a 10 foot length. Inflatables in the 18 to 20 foot range may cost as much as $24,000.00.

The closest prior art that I have been able to find is the auto bra. I can find no patent number on any that I have seen for sale. This is designed to cover the front of the fenders and grill of an auto. The material is a soft vinyl for the purpose of protecting against rock chips in the auto paint.

The inflatable boat bra is used in a totally different industry, on different products, offers protection against different assaults, fastens in a different manner and adds a feature of equipment organization by the use of mesh bags that fit along the inside of the inflatable boat. The very nature of inflatable boats require that the manufacturer use fabrics that will hold air and are resistant to sun rot. These fabrics are prone to laceration and puncture. Heretofore the recommended solution for leaks has been to apply a patch to the boat fabric. Often times the patch must be applied while the boat is in use and will not hold. A hole close to a boat feature, such as a seam or D ring, is almost impossible to patch due to a change in surface level.

An additional use of the bra is to organize equipment. Inflatable boats are commonly purchased as work or sport boats These activities usually entail the carrying of considerable equipment that ends up in a pile on the floor of the boat. Moving from one end to the other of the boat becomes very difficult because of a disorganized pile of equipment. This also tends to damage the more delicate equipment. Attached to the bra in the area to be inside of the inflatable boat are a plurality of mesh nylon pouches. These are used to organize the equipment that is being used in the boat.

Most inflatables are gray, white, black or some other color that is difficult to see in rough water. A drab color is a severe disadvantage if the inflatable boat is used as a life raft or lost at sea.

OBJECTS AND ADVANTAGES

The objects and advantages for my invention are:

(a) It helps solve the problem of leaks in inflatable boats from the preventive perspective, not the repair perspective.

(b) Can be made from the most abrasion and laceration resistant fabric with total disregard for holding air.

(c) Extends the life of costly inflatable boats.

(d) Organizes costly and delicate equipment of avoid damage.

(e) Has a large color variety making the inflatable boat more visible in rough water, adding a safety factor.

DRAWINGS AND FIGURES

In the drawings closely related figures may have the same number but different alphabetical suffixes:

Figure 7:
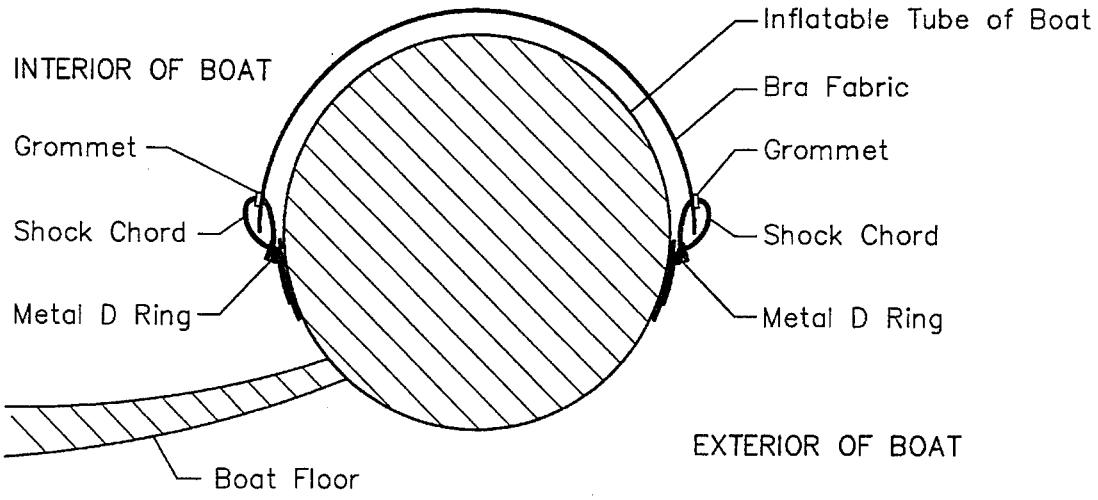

FIG. 7 shows an overall view of the inflatable boat bra as it fits on an inflatable boat. The method of attachment is a major aspect in the effectiveness of abrasion resistance. The use of D rings and shock cords instead of more ridged application, allows the fabric of the bra to slide over the fabric of the boat, preventing damage to either.

Figure 8:
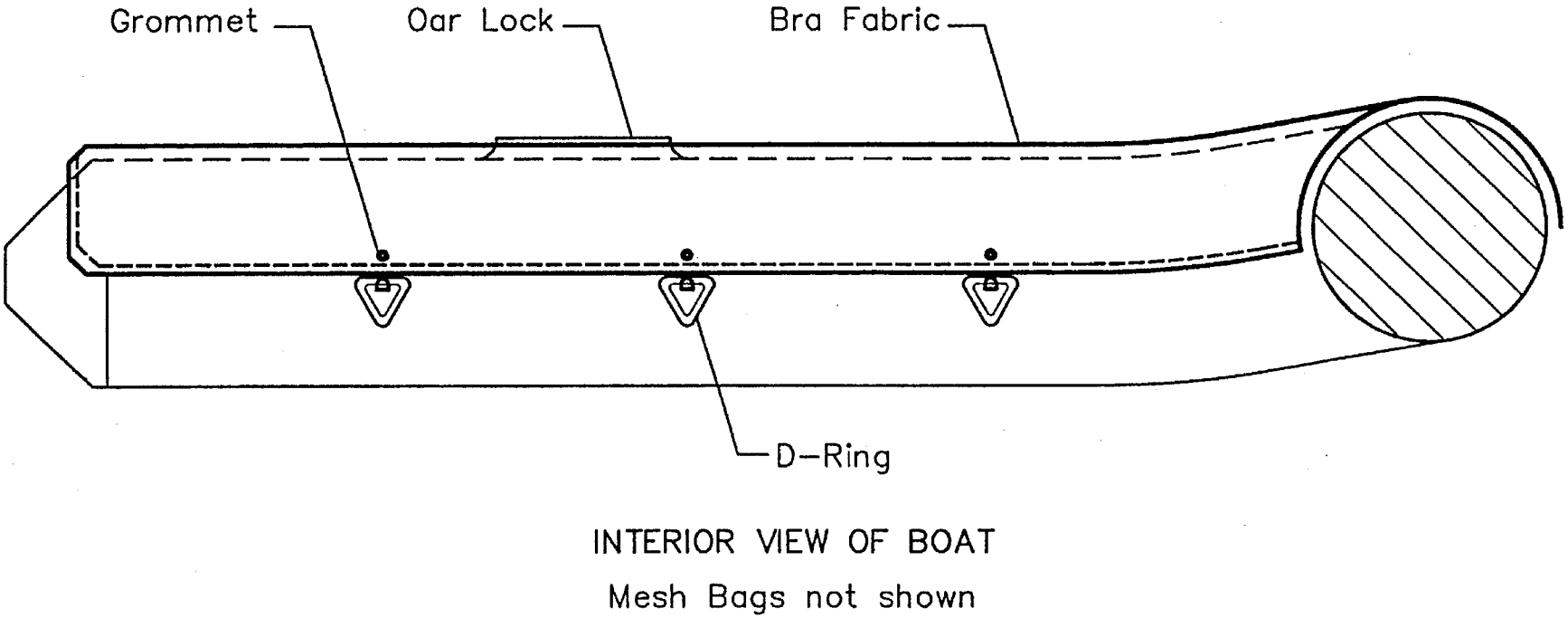

FIG. 8 depicts a cut away view of how the bra is positioned from the interior of the boat.

Figure 9:
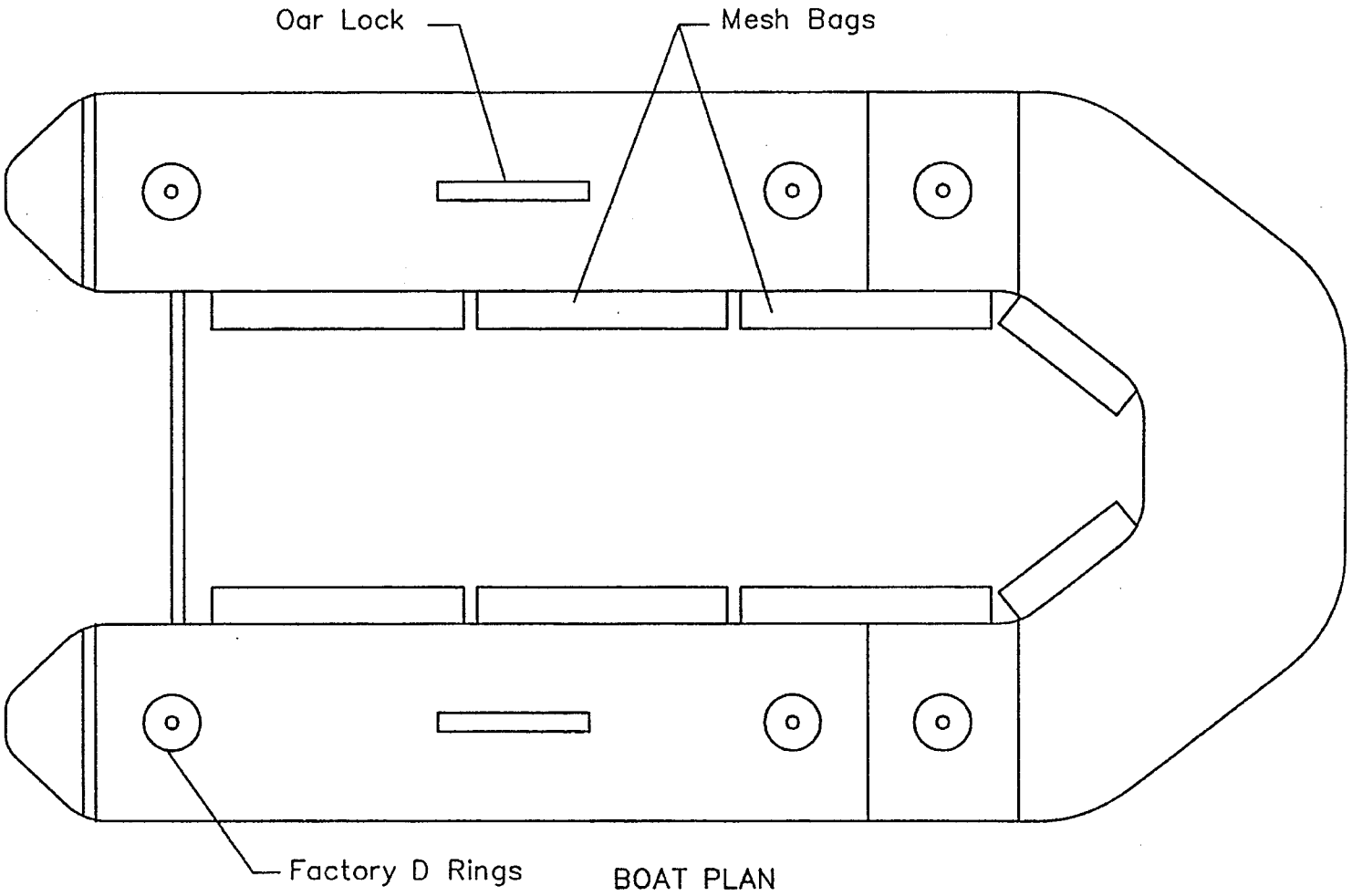

FIG. 9 shows a view of the inflatable boat from above depicting the location of a plurality of mesh bags that are the organizational aspect of this invention.

Further objects and advantages are to provide an inexpensive but fashionable protection for almost all inflatable equipment. This type of preventive protection is very light weight and can be made of many different fabrics in an unlimited variety of shapes and sizes. Still further objects and advantages will become apparent from a consideration of the ensuing description and drawings.

DESCRIPTION OF FIGS. 1–9

Figure 1A:
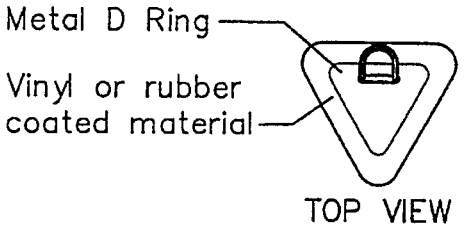
FIG. 1A depicts a top view of a D ring that is glued to the boat to secure the bra.
Figure 1B:
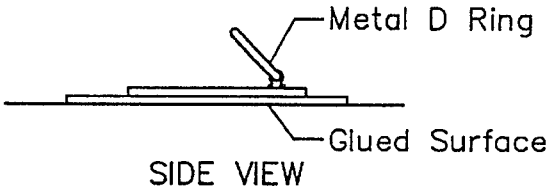
FIG. 1B depicts a side view of a D Ring.

The fasteners of choice to be glued onto the fabric of the boat's inflatable tube is the common D ring (FIG. 1). The fastening pad is made of a nylon and PVC laminated with a stainless steel D shaped ring at the pad center. I don't believe an active patent exists for this object as, to my knowledge, it has been universally for sale for over 20 years.

Figure 2A:
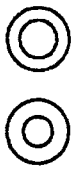
FIG. 2A shows a top view of a grommet that is attached to the bra fabric in close proximity to the D ring (FIG. 1).
Figure 2B:
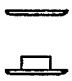
FIG. 2B depicts a side view of a grommet.

The grommets fastened to the bra fabric (FIG. 2) can be of brass or plastic material. These fasten to the bra fabric in close proximity to the D rings. The grommet is without an active patent as it has been for sale for over 20 years.

The shock cord (FIG. 3) is to fasten together a D ring (FIG. 1) and a grommet (FIG. 2) thus helping to secure the bra fabric to the inflatable tube of the boat. The shock cord (FIG. 3) is also used to fasten the bra fabric to the conically tapered aft (rear) end of the round inflatable tube of the boat. This is done by a drawstring effect.

Figure 4:
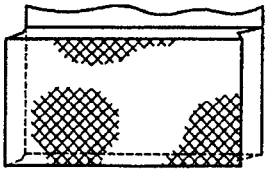
FIG. 4 depicts a nylon mesh pouch for organizing equipment on the inside of the boat.

The portion of the bra fabric that covers the interior aspect of the boat tube has fastened to it the organizing pouches (FIG. 4). These nylon mesh pouches can be flat stitched or made with a bellows, and can be either a detachable form or permanently fastened to the bra fabric or a combination of both. They are designed to hold equipment in an organized manner. A mesh fabric is used to allow water to pass out of the pouch while the equipment remains visible.

Figures 5A, 5B:
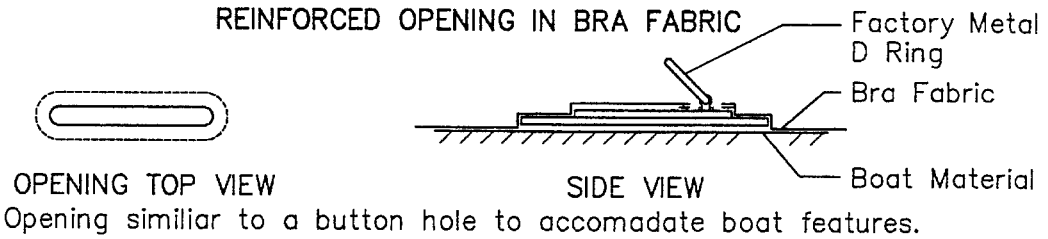
FIG. 5A is a top view of a button-hole type opening designed to allow passage of a D ring that is existing standard equipment on an inflatable tube of the boat.
FIG. 5B is a side view of a button-hole type opening designed to allow passage of a D ring that is standard equipment on an inflatable tube of the boat.

The bra fabric has a number of reinforced openings in it (FIG. 5) to allow the passage of factory installed D rings whose purpose is to fasten a safety rope to the top of the inflatable tube of the boat.

Figures 6A, 6B:
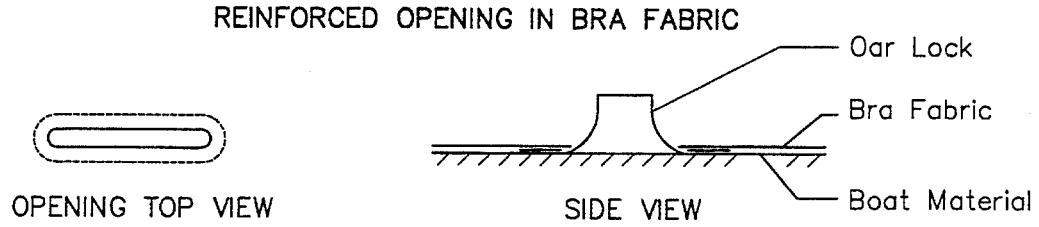
FIG. 6A is a top view of a button-hole type opening that is designed to allow passage of an oar lock that is standard equipment on an inflatable tube of the boat.
FIG. 6B is a side view of a button-hole type opening that is designed to allow passage of an oar lock that is standard equipment on an inflatable tube of the boat.

One of the propulsion methods of the boat is rowing with oars. The oar locks protrude through the reinforced openings in the bra fabric (FIG. 6).

OPERATION

To make the bra usable it must be fastened to the inflatable boat or other inflatable object for which it is made. The size and shape of the bra must vary according to the size and shape of the inflatable boat or inflatable object that it is designed to protect and organize. To apply the bra unfold it and lay it out on the boat so that the shapes coincide. The bra is U shaped so be sure the closed end of the bra lays along the forward end of the boat. The tubes should be about ⅔ inflated at this time. Pull the bra around the tube so it covers the entire upper ⅗. Note that the grommets are spaced along the inside and outside edge of the bra fabric. The material should extend 4 to 5 inches below the center line of the outside of the boat tube. This should align the reinforced openings in the bra fabric (FIGS. 5 and 6) with the oar locks and D rings that must pass through them.

Align as perfectly as possible the bra fabric onto the boat tubes. Now glue a D ring on the outside toward the back of each inflatable tube and two to the outside and forward aspect of the tube, in close proximity to the grommets in the bra fabric. Allow the glue to cure.

Figure 3:
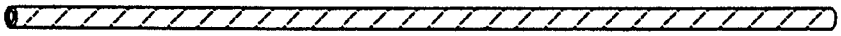
FIG. 3 depicts a shock cord that attaches the D rings (FIG. 1) and the grommets (FIG. 2) together and that puckers the fabric in, around the aft (rear) of the inflatable tubes.

Next take the shock cord (FIG. 3) and securly tie the grommets and the D ring together in the very front and back of the boat. Now is the time to inflate the boat tubes to their recommended pressure. This should snug the bra to the boat tubes and you can make any last minute adjustments that are necessary. Glue on the remaining D rings, one in close alignment with each grommet. Allow time for the glue to cure and fasten the remaining grommets and D rings together with the shock cord (FIG. 3). This should secure the bra to the boat.

Attaching the bra to the inflatable with the D ring grommet and shock cord method is a very important aspect of producing protection from abrasions. With this method it allows the bra fabric to slide over the inflatable fabric when contact is made with a sharp object. This slide factor further reduces the laceration protential of the already laceration resistant bra fabric and is a key principle that makes this invention work.

The organizing mesh pouches should be hanging easily and ready to use.

SUMMARY RAMIFICATIONS AND SCOPE

One of the major frustrations and life shortening weaknesses of inflatable boats is their susceptability to abrasion and lacerations creating leaks. Further frustration and equipment damage is caused by the difficulty of organizing equipment in the boat. The Inflatable Boat Bra helps to solve both leakage and organizational problems. Being made of highly abrasive and lacerative resistant material and also providing see through mesh pouches for organizing equipment.

The bra can be made of highly visible colors making the boat easy to find even in rough water. This becomes important if the boat is lost at sea or if the boat is used as a life raft.

Although the description above contains many specificties, these should not be construed as limiting the scope of the invention but as providing illustrations of some of the presently prefered uses of this invention. For example: the bra can be made to fit over any inflatable or abrasion prone equipment. Thus the scope of the invention should be determined by the appended claims and their legal equivalents, rather than by examples given.

I claim:

1. A fabric covering assembly for covering an inflatable object to protect it from abrasions, lacerations, and deflation, comprising:

(a) a sheet of fabric of a size to cover a substantial portion of the exterior of an inflatable object and including a plurality of reinforced openings to accommodate the passage of existing protrusions on said inflatable object, (b) a plurality of grommet fasteners, (c) a plurality of adhesive fasteners with D-rings, (d) a plurality of mesh pouches, (e) a plurality of elastic shock cords, (f) means for joining said grommet fasteners to said sheet of fabric at spaced locations, (g) means for joining said adhesive fasteners to said inflatable object at spaced locations, (h) means for joining said mesh pouches to said sheet of fabric, (i) said grommet fasteners being joined to the sheet of fabric, and the adhesive fasteners being joined to the inflatable object, and further wherein said grommet fasteners and said adhesive fasteners are fastened together by means of said elastic shock cords thereby holding said sheet of fabric snugly on said inflatable object, and said mesh bags joined to the sheet of fabric providing a system for storing equipment on the inside of said inflatable object.

* * * * *